United States Patent [19]

Miffre

[11] Patent Number: 4,742,871

[45] Date of Patent: May 10, 1988

[54] DEVICE FOR POSITIONING A TOOL WITHIN A WELLBORE FLOW STRING

[75] Inventor: Hubert Miffre, Tourves, France

[73] Assignee: Societe Nationale Elf Aquitaine (Production), Courbevoie, France

[21] Appl. No.: 885,683

[22] Filed: Jul. 15, 1986

[30] Foreign Application Priority Data

Jul. 31, 1985 [FR] France ..... 85 11682

[51] Int. Cl.[4] ..... E21B 23/03

[52] U.S. Cl. ..... 166/117.5

[58] Field of Search ..... 166/117.5, 117.6, 242, 166/313, 381, 50, 52, 113, 115, 117; 175/77–79

[56] References Cited

U.S. PATENT DOCUMENTS

| | | | |
|---|---|---|---|
| 2,492,079 | 12/1949 | Wiley | 166/117.5 |
| 2,999,543 | 9/1961 | Myers | 166/313 |
| 3,561,528 | 2/1971 | Butler et al. | 166/117.5 |
| 3,796,259 | 3/1974 | Outhouse | 166/117.5 |
| 4,051,895 | 10/1977 | Embree | 166/117.5 |
| 4,067,385 | 1/1978 | Schwager et al. | 166/313 |
| 4,294,313 | 10/1981 | Schwegman | 166/117.5 |
| 4,368,780 | 1/1983 | Merritt | 166/117.5 |
| 4,396,075 | 8/1983 | Wood et al. | 175/79 |
| 4,415,205 | 11/1983 | Rehm et al. | 299/5 |
| 4,444,276 | 4/1984 | Peterson, Jr. | 175/61 |
| 4,508,166 | 4/1985 | Becker et al. | 166/117.5 |

FOREIGN PATENT DOCUMENTS

| | | | |
|---|---|---|---|
| 136935 | 4/1985 | European Pat. Off. . | |
| 2551491 | 3/1985 | France . | |
| 2156880 | 10/1985 | United Kingdom | 166/117.5 |

*Primary Examiner*—James A. Leppink
*Assistant Examiner*—Hoang C. Dang
*Attorney, Agent, or Firm*—Schwartz, Jeffery, Schwaab, Mack, Blumenthal & Evans

[57] ABSTRACT

A tool-positioning device is composed of a branch assembly in which each branch tube communicates with each branch flow string, an intermediate assembly provided with convergent tubes and a connecting assembly provided with a spline for guiding the connecting assembly with respect to one of the flow strings. An orientation and guiding member is interposed between the intermediate assembly and pumping means housed within a production tube. The orientation and guiding member has a slit which is oriented with respect to the spline in order to have a fixed and invariable position.

19 Claims, 2 Drawing Sheets

DEVICE FOR POSITIONING A TOOL WITHIN A WELLBORE FLOW STRING

BACKGROUND OF THE INVENTION

1. Field of the Invention

The present invention relates to a device for positioning a tool within the flow string of a wellbore and more particularly of a petroleum-producing wellbore.

2. Description of the Prior Art

Branched wells or so-called multiple-completion wells in which lateral boreholes are connected to a main vertical wellbore and are inclined at a predetermined angle with respect to the main wellbore are coming into increasingly widespread use, especially in order to increase the production of the main well, also known as the "parent" well.

The processes of drilling of branched multiple-completion wells and recovery from producing formations both in the case of petroleum reservoir exploitation and in the case of subsurface mining are practiced for many reasons which include economic considerations or factors relating to the nature of the productive stratum or mineral deposit.

In fact, the lateral branches of a parent well not only permit an increase in production but also permit maximum recovery of the contents of a producing formation. In addition, these branch-type boreholes permit extension of the subsurface producing zone by means of a single surface installation and also make it possible to reduce the high flow resistance which appears in the vicinity of the borehole within a parent well.

A further practical advantage of branch-type boreholes lies in the possibility of recovering oil and gas from formations or strata which have a large number of fractures. This possibility arises from the fact that the lateral branch lines intercept the fractures and connect them to the drainage system of the parent well.

Finally, branched multiple-completion wells are widely utilized for effective exploitation of a pay formation in which the top or superincumbent stratum of the reservoir has a highly irregular relief and/or a small thickness.

In the prior art, branch-type boreholes were drilled in a direction away from the parent well with a deflecting tool known as a whipstock. It is readily apparent that branch-boreholes are smaller in diameter than the parent wellbore and the angle of deflection of each branch-borehole is chosen as a function of the producing formation zone into which the branch hole is intended to open. In order to minimize drilling costs, the same whipstock or deflecting tool is sometimes employed for drilling two branch holes which are symmetrical with respect to the parent wellbore by rotating the deflecting tool through an angle of 180° within the parent wellbore. Branched multiple-completion wells drilled in this manner by means of deflecting tools are described in U.S. Pat. Nos. 4,396,075 and 4,415,205.

When each branch-borehole has been completely drilled, the elements required for recovery of oil or gas from the deposit are then run into the hole. When all the branch holes are ready for use, all equipment which serves no useful purpose for production are withdrawn from the parent well. One item of such equipment is the whipstock, for example.

A point worthy of note at this juncture is that the structure of a parent well associated with branch-type boreholes in a multiple-completion oil-well installation is attended by a disadvantage in that no provision is made for any selective connection between the bottom of each branch hole and the surface.

Throughout the foregoing discussion, reference has been made to lateral branch lines or boreholes. It will be understood, however, that the branch-boreholes can extend obliquely, horizontally or in any direction provided that they are associated with a main or parent wellbore to which they are joined in convergent relation.

As long as the branch lines are in service or in other words are operating under production conditions of continuous flow, no major difficulty arises.

In contrast, when one or a number of branch lines has been put out of service and it is desired to reactivate or put the line back into service, major difficulties are then encountered.

The first of these difficulties is primarily related to the fact that, during the period of service, the branch line (tubing string) has become clogged with drill cuttings and débris which it is very difficult to locate with any degree of accuracy. It would admittedly be possible each time a whipstock is run into a wellbore for drilling a branch hole to note very precisely its position within the parent wellbore and then to replace the deflecting tool at exactly the same location. Such an operation, however, appears to be very difficult to perform in practice.

The second difficulty lies in the fact that, even assuming that it were possible to relocate the original branch hole, it would be absolutely essential to reuse the same deflecting tool either for removing all débris from this reactivated branch hole or to carry out a second drilling operation.

In view of these major difficulties, it has thus far proved preferable not to put old branch holes back into service but to drill new holes. Even though it is true that drilling of a branch hole is not comparable with the work involved in drilling a main vertical wellbore, it still remains a very costly operation.

In order to overcome the drawbacks discussed in the foregoing, it has already been proposed to provide a device which permits normal production when branch lines are in service but which also makes it possible beforehand to disconnect a lost casing joint (length of casing) which may subsequently be reconnected at the surface, if necessary with a view to reactivating one or a number of branch lines after they have been put out of service, this being possible without entailing high capital expenditure.

A device of this type is described in French patent application No. 83 13981. The device for drilling and initiating production of an oil or gas well formed by a parent wellbore and at least one branch-borehole which opens into said parent wellbore includes an outer casing placed within the parent wellbore, at least one branch assembly fixed in situ within said casing and provided with at least one fixed branch tube whose lower end communicates with a branched multiple-completion well. By means of a connecting assembly associated with a positioning assembly, any branch hole can be drilled and put back into service after use, this being made possible by a fixed positioning-assembly spline on which a cam profile of the connecting assembly is applied.

In practice, however, it has been found that, each time it proves necessary to carry out a servicing operation within a lateral branch hole or branch tubing string during the production stage, it is necessary to raise the pump and production tubing to the surface, then to lower the drill pipe. When the servicing operation is completed, the production tubing and pump are replaced in position. These operations involving raising and lowering of production tubing and pump are not only costly in themselves but above all result in outage of the entire oil-well installation over relatively long periods of time. From a production standpoint, however, it is clearly advisable for both technical and economic reasons to avoid such outages wherever possible.

The present invention solves the problem set forth in the foregoing by considerably reducing the outage time of a producing well. To this end, a device is proposed for correctly positioning a servicing tool within the borehole concerned without having to raise the production tubing to the surface.

It should be understood that the term "servicing operation" used in the foregoing and throughout this specification is intended to mean any operation to be performed within a lateral borehole, designated hereinafter as a branch flow string. For example, operations of this type can include interference measurements or else water-exclusion plug-back operations.

SUMMARY OF THE INVENTION

The device in accordance with the invention includes a branch assembly which is fixed in situ within the wellbore and is provided with a plurality of branch tubes, the lower end of each branch tube being adapted to communicate with a branch flow string of said wellbore. A receptacle is fixed on the branch assembly and provided with bores from which access can be gained to the branch tubes and a fixed guiding spline is mounted on said receptacle. The distinctive feature of the device lies in the fact that an orientation and guiding member is rigidly fixed to the receptacle and provided with a slit which is oriented with respect to the guiding spline and in which one of the tool-orientation splines is displaceably mounted. In accordance with another distinctive feature, means are provided on said tool for cooperating with said orientation and guiding member in order to release and displace the tool head when said head is correctly positioned with respect to the selected branch flow string.

By virtue of the present invention, the servicing tool is pre-oriented at the surface by correct positioning of the orientation sleeve with respect to the branch flow string into which the tool is to be run.

BRIEF DESCRIPTION OF THE DRAWINGS

Other features of the invention will be more apparent to those skilled in the art upon consideration of the following description and accompanying drawings, wherein.

Figure 1:
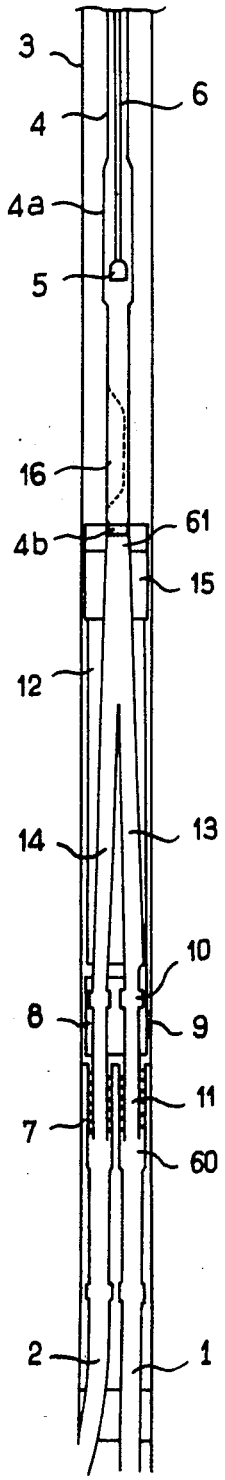
FIG. 1 is a highly schematic fragmentary part-sectional view of a branched multiple-completion well.
Figure 2:
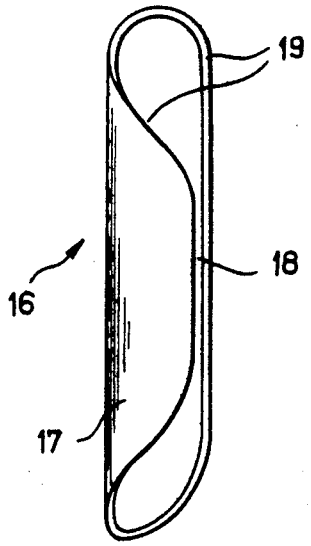
FIG. 2 is a perspective view showing the orientation and guiding member of the device in accordance with the invention.

A connecting assembly 8 is rigidly fixed to the base element 7 and has a cam profile which is applied against a fixed spline 9. The assembly 8 is also provided with housings 10 for plugs and tubes 11 which are inserted within bores 60 formed in the base element 7 so as to ensure that the tubes 11 communicate through said base element 7 with the branch flow strings 1, 2 of the wellbore.

An intermediate assembly 12 is fixed on the connecting assembly 8 and has three tubes, only two tubes 13,14 being shown in the drawings. Said tubes converge towards the head 15 in order to form a single inlet orifice 61 within said head whereas each tube aforesaid opens at the lower end of said intermediate assembly into one of the tubes of the connecting assembly 8.

An orientation and guiding member 16 is constituted by a hollow jacket 17 having a longitudinal slit 18 which is oriented with respect to the cam profile of the connecting assembly 8. Said connecting assembly is in turn suitably oriented by means of the fixed spline 9.

The orientation member 16 is interposed between the production tubing 4 and the intermediate assembly 12, said production tubing 4 being provided with an extension **4*b* which is introduced into the inlet orifice 61 of the head 15**.

The engagement edges 19 of said longitudinal slit 18 are flared-out and their sharp edges are ground so as to permit smooth sliding motion over the edges.

Figure 3:
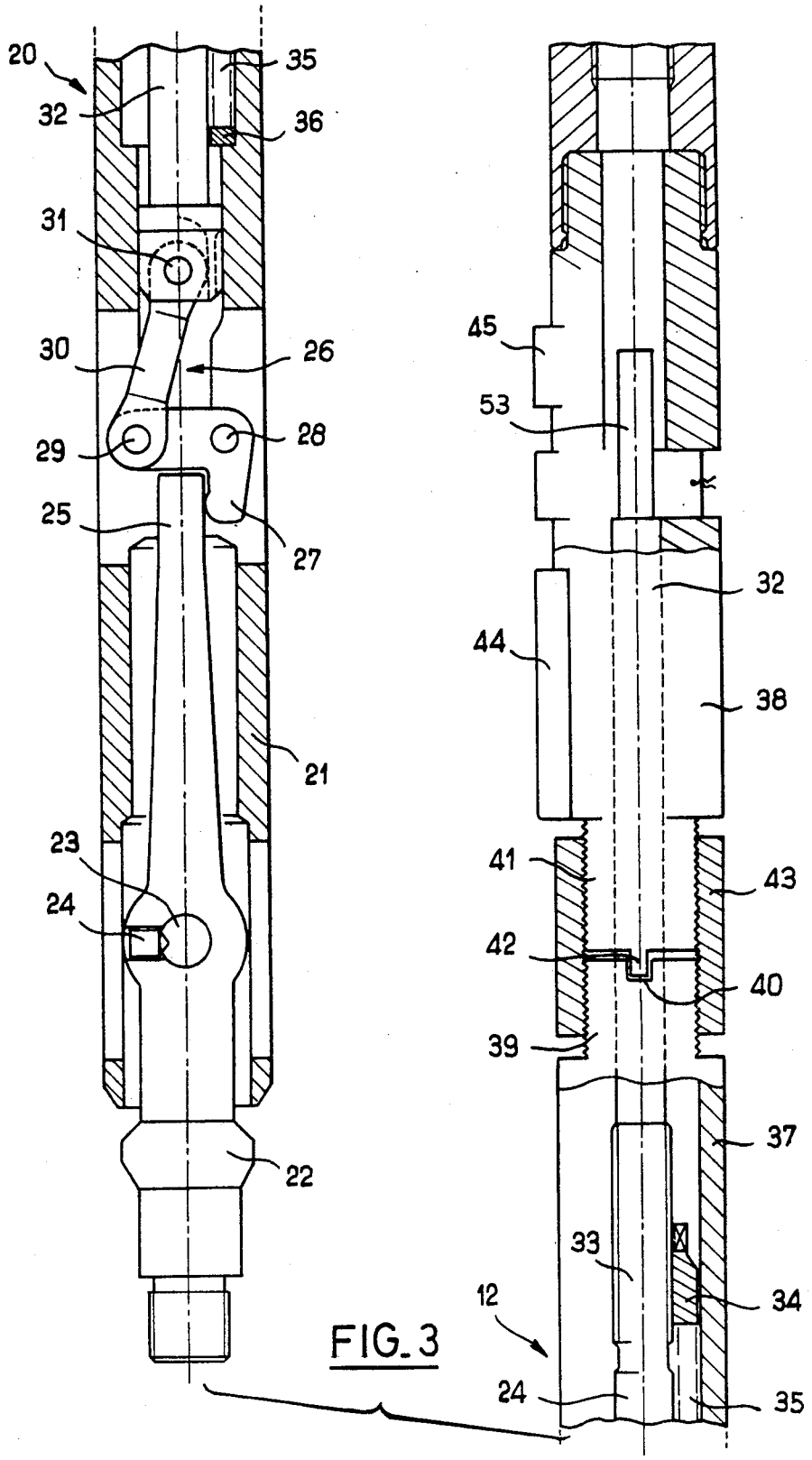
FIG. 3 is a sectional view of a servicing tool fitted with part of the device in accordance with the invention.

In a preferred embodiment shown in FIG. 3 the servicing tool 20 includes a body 21, a member 22 having an end portion which projects downwardly from the body 21, an extension member (not shown in the drawings) connected to said tool the end portion of the member 22 and having a variable length, the extension member being intended to be introduced into the selected branch flow string in which the servicing operation is to be performed. The greater part of the member 22 is housed within the tool body 21 and is pivotally mounted on a pin 23, said pin being held in position by a locking screw 24. As illustrated in FIG. 3, the upper end 25 of the member 22 is adapted to cooperate with a system of crank-arms 26 each having a lever 27 pivotally mounted on two pins 28, 29 and a crank-arm 30 which is pivotally mounted at one end on the pin 29 and at the other end on a pin 31. A rod 32 rigidly fixed to the system of crank-arms 26 and housed within the tool body 21 has a threaded portion 33 which engages in a nut 34. The nut serves as a bearing member for one end of a compression spring 35 which is placed around said rod 32, the other end of said spring being applied against a washer 36 which is attached to the tool body 21. The nut 34 is also employed for adjusting the tension of the spring 35.

The tool body 21 is mainly composed of two sections, namely a lower section 37 and an upper section 38. The free top end 39 of the lower tool-body section 37 is threaded and provided with three recesses 40 relatively spaced at angular intervals of 120° or, more generally, distributed in the same manner as the branch flow strings of the wellbore. The free bottom end 41 of the upper tool-body section 38 is also threaded and terminates in a locking stud 42. A right-and-left sleeve 43 with internal screw-threads of opposite hand provides a coupling between the ends 39 and 41. When the coupling sleeve 43 is rotated in one direction such as the clockwise direction, for example, the ends 39 and 41 move away from each other until the stud 42 is freed from the recess in which it was engaged. Once the stud 42 is located above another recess 40, the coupling sleeve 43 is rotated in the anticlockwise direction and the two ends 39 and 41 are moved towards each other in order to insert the stud 42 in the corresponding recess 40 and thus to lock the upper and lower tool-body sections in the new position. It is readily apparent that the rod 32 traverses the top and bottom walls of the tool 20 and terminates in an end portion 53, the design function of which will hereinafter be explained in greater detail.

The upper tool-body section 38 is provided with an orientation spline 44. A guiding spline 45 is also provided for ensuring a good sliding action.

The diameter of the orientation and guiding splines 44 and 45 is slightly larger than the diameter of the tool body 21 in order to ensure that the orientation splines 44 and 45 can engage within the slit 18 of the jacket 17.

Figure 4:
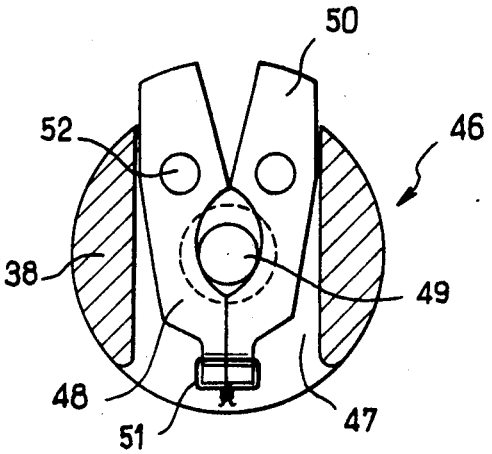
FIG. 4 is an enlarged sectional view showing the means employed for releasing the head of the servicing tool. cDETAILED DESCRIPTION OF THE INVENTION A branched multiple-completion well as shown in highly schematic form in FIG. 1 contains, for example, a main vertical wellbore 1 and one or a number of lateral branch flow strings, only one branch flow string 2 being illustrated in the figure. In the usual manner, the wellbore is provided with a casing string 3 which extends to the bottom of the parent well, a production tube 4 placed within the casing string 3, and a pump 5. The pump is lowered into a widened portion **4*a* of the production tubing until it reaches a predetermined depth, pump 5 being suspended from a string of pumping rods, or so-called sucker rods. A receptacle or base element 7 is stationarily fixed within the borehole, for example by cementing or any other suitable fixing means, and is formed by a plurality of tubes each adapted to communicate at the lower end with one branch flow string of the wellbore. The base element 7** is provided with a number of orifices corresponding to the number of branch flow strings within the wellbore. In a wellbore containing three branch flow strings relatively spaced at angular intervals of 120°, the base element will have three orifices spaced at 120°, each orifice being intended to correspond to one of the branch flow strings and being joined to this latter. A base element of this type is described in the French patent application mentioned earlier and is designated as a branch assembly.

A system 46 for initiating forward displacement of the member 22 is housed within a window 47 formed in the upper tool-body section 38. The system 46 includes a tong unit 48 which is mounted on a reduced-diameter portion 49 of the rod 32 (as shown in FIG. 4). The tong-arms 50 are maintained in a correct position by a rupture wire 51 and are each pivotally mounted on a pin 52. In this position, the spacing of the tong-arms is greater than the width of the slit 18.

The device in accordance with the invention operates as follows :

After raising the pump 5 by means of a crane, for example, the servicing tool is pre-oriented at the surface by means of a plate (not shown in the drawings) provided with orifices located vertically above the orifices of the base element 7 and the tool is then run into the borehole in this position. As a result of this pre-orientation and by virtue of the fact that the jacket 17 is also oriented with respect to the tubing strings of the wellbore, the orientation spline 44 of the tool engages in the slit 18 of said jacket, whereupon the member 22 is positioned with respect to said tubing string in which the servicing operation is to take place.

As soon as the arms 50 of the tong unit 48 are abuttingly applied against the engagement edges 19 of the slit 18, the edges accordingly perform the function of a cam for said tong-arms which, as they move towards each other, exert a tractive force on the rupture wire 51. When the wire breaks, the end of the portion 49 of the rod 32 which was applied on the tong-arms 50 is released, with the result that the rod 32 is no longer locked in position. By means of the spring 35 which has a force of the order of 150 to 200 kg, the rod 32 is consequently displaced upwardly in FIG. 3. This movement of the rod 32 in turn produces a displacement of the crank-arm 30. The lever 27 which bears on the end portion 25 of the member 22 accordingly produces a pivotal displacement of the member 22 through an angle of approximately 3° in order to ensure that the extension member which is associated with the member 22 is in fact correctly located within the selected tubing string and is not liable to jam against the wall of said tubing string.

When it is desired to gain access to another tubing string, the procedure described in the foregoing is repeated by moving the stud 42 into another recess 40 of the lower tool-body section. Under these conditions, the tool is oriented in a different azimuth corresponding to another tubing string located at an angular distance of 120° from the previous tubing string.

It is also possible to contemplate the use of the tool in accordance with the invention in the mining field and especially in conjunction with the devices described in the U.S. patents.

As will readily be apparent, the invention is not limited in any sense to the embodiment described in the foregoing and illustrated in the accompanying drawings. Depending on the applications considered, numerous alternative embodiments within the capacity of those versed in the art could be adopted without thereby departing either from the scope or the spirit of the invention as set forth in the claims.

What is claimed is:

1. A device for positioning a tool head within a selected one of a plurality of flow strings of a wellbore, comprising a branch assembly fixed in site within the wellbore, said branch assemble including a plurality of flow string communicating means, connecting means positioned above said branch asembly and provided with first tubes communicating with said flow string communicating means of the branch assembly, an intermediate assembly in which are housed second tubes converging at one end thereof towards a single inlet provided in a head of said intermediate assembly, said second tubes communicating at the other end thereof with the first tubes of the connecting assembly, a production tube communicating with said intermediate assembly, orientation means at a location within said production tube; and a servicing tool adapted to be lowered into said production tube, said servicing tool comprising an upper tool-body section and a lower tool-body section, said upper section provided with means for engaging said orientation means, said servicing tool further comprising means pivotally connected to said lower body section for receiving a tool head, means also connected to said lower body section for pivoting said receiving means in a direction relative to said lower body section and means for selectively adjusting angular relationship between said upper and lower sections so that upon engagement of said upper section with said orientation means, said pivoting direction is angularly aligned with a selected one of said flow string communicating means, said adjusting means including a stud on one of said first and second body sections and a plurality of recesses on the other of said first and second body sections, each recess adapted to receive said stud, said pivoting means including means for urging said receiving means to pivot and means for releasing said urging means, said urging and releasing means carried by said servicing tool.

2. The device according to claim 1, wherein the production tube is extended downwardly beyond the orientation means and is inserted in the single inlet of the intermediate assembly.

3. The device according to claim 1, wherein the upper and lower tool-body sections are coupled together by a sleeve.

4. The device according to claim 3, wherein the coupling sleeve includes means for causing a relative displacement of said upper and lower tool-body sections with respect to each other upon a rotational displacement of the sleeve.

5. The device according to claim 1, wherein the servicing tool is pre-oriented at ground level with respect to the selected flow string.

6. The device according to claim 1, wherein the orientation means includes a slit and the upper tool-body section is provided with an orientation spline adapted to engage said slit.

7. The device according to claim 6, wherein the releasing means includes a tong unit in which tong-arms are adapted to engage within the slit of the orientation means, the slit and said tong-arms cooperating to release an actuating rod operatively connected to said receiving means.

8. The device according to claim 7, wherein the actuating rod is biased by prestressed spring which urges said actuating rod to a released position.

9. The device according to claim 7, wherein said tong-arms and said receiving means are spaced apart for angularly displacing the receiving means at a time of introduction of the tool head into the slected flow string.

10. The device according to claim 7, wherein the angular displacement is approximately three degrees.

11. The device according to claim 7, wherein the urging means includes a system of crank-arms interposed between the receiving means and the actuating rod.

12. The device according to claim 7, wherein the receiving means includes a member which is pivotally mounted on a pivot-pin.

13. The device according to claim 7, wherein the tong unit is housed within a window formed in the upper tool-body section.

14. A servicing tool adapted to be lowered within a production tubing, comprising:

an upper tool-body section;

a lower tool-body section;

an outer coupling sleeve for connecting said upper and lower body sections, said coupling sleeve cooperating with the upper and lower body sections so that a rotational displacement of the sleeve causes a relative displacement of said upper and lower body sections with respect to each other;

means pivotally connected to said lower body section for receiving a tool head;

means also connected to said lower body section for pivoting said receiving means relative to said lower body section, said pivoting means including means for urging said receiving means to pivot and means for releasing said urging means, said urging means including an actuating rod operatively connected with said receiving means and said releasing means comprising a tong unit having long arms, an orientation and guiding member disposed within the production tubing and having a slit therein, said tong arms engaging said slit.

15. The servicing tool according to claim 14, wherein the upper body section is provided with a spline for engaging the slit of the orientation and guiding member.

16. The device according to claim 14, wherein the actuating rod is biased by a spring which urges said actuating rod to a released position.

17. The device according to claim 14, wherein the angular displacement of the receiving means is approximately three degrees.

18. The device according to claim 14, wherein the actuating rod is operatively connected with said receiving means by a system of crank-arms.

19. A servicing tool adapted to be lowered within a production tubing, comprising:

an upper tool-body section provided with a spline for engaging a slit of an orientation and guiding member;

a lower tool-body section;

an outer coupling sleeve for connecting said upper and lower body sections, said coupling sleeve cooperating with the upper and lower body sections so that a rotational displacement of the sleeve causes a relative displacement of said upper and lower body sections with respect to each other;

means pivotally connected to said lower body section for receiving a tool head;

means also connected to said lower body section for pivoting said receiving means relative to said lower section, said pivoting means including means for urging said receiving means to pivot and means for releasing said urging means, said urging means including an actuating rod operatively connected with said receiving means, said releasing means comprising a tong unit having tong arms, an orientation and guiding member disposed within the production tubing and having a slit therein, said tong arms engaging said slit; and means for selectively adjusting angular relationship between said upper and lower sections including a stud in one of said upper and lower sections and a plurality of recesses in the other of said sections, each recess adapted to receive said stud.

* * * * *